US007993037B1

(12) United States Patent
Buse

(10) Patent No.: US 7,993,037 B1
(45) Date of Patent: Aug. 9, 2011

(54) RECESSED LIGHT FIXTURE WITH A MOVABLE JUNCTION BOX

(75) Inventor: John Jeffrey Buse, Mooreville, MS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 338 days.

(21) Appl. No.: 12/198,963

(22) Filed: Aug. 27, 2008

(51) Int. Cl.
*F21V 15/00* (2006.01)

(52) U.S. Cl. ..... 362/365; 362/362; 362/364; 362/368

(58) Field of Classification Search ..... 362/362, 362/364–365, 368
See application file for complete search history.

(56) References Cited

U.S. PATENT DOCUMENTS

| | | | |
|---|---|---|---|
| 1,878,084 | A | 9/1932 | Winkler |
| 2,000,241 | A | 5/1935 | Mangin |
| 2,319,621 | A | 5/1943 | McLaughlin |
| 2,331,498 | A | 10/1943 | Otto |
| 2,489,245 | A | 11/1949 | Sola |
| 2,518,936 | A | 8/1950 | Roberts |
| 2,541,828 | A | 2/1951 | Peck |
| 2,602,881 | A | 7/1952 | Pryne |
| 2,702,378 | A | 2/1955 | Talty |
| 2,716,185 | A | 8/1955 | Burliuk |
| 2,719,374 | A | 10/1955 | Paione |
| 2,736,528 | A | 2/1956 | Brock |
| 2,741,695 | A | 4/1956 | Schockett |
| 2,787,702 | A | 4/1957 | Oster |
| 2,802,933 | A | 8/1957 | Broadwin |
| 2,841,281 | A | 7/1958 | Chisholm |
| 2,863,990 | A | 12/1958 | Wince |
| 2,965,348 | A | 12/1960 | Gerstel |
| 3,003,735 | A | 10/1961 | Havener |
| 3,057,993 | A | 10/1962 | Gellert |
| 3,061,258 | A | 10/1962 | Grenier |
| 3,082,023 | A | 3/1963 | Rudolph |
| 3,100,642 | A | 8/1963 | Goldstein |
| 3,118,621 | A | 1/1964 | Bailey |
| 3,130,949 | A | 4/1964 | Erhardt |
| 3,144,502 | A | 8/1964 | Weiss |
| 3,158,329 | A | 11/1964 | Wince |
| 3,182,187 | A | 5/1965 | Gellert |
| 3,247,368 | A | 4/1966 | McHugh |
| 3,281,522 | A | 10/1966 | Anisfield |
| 3,313,931 | A | 4/1967 | Klugman |
| 3,316,399 | A | 4/1967 | Totten |
| 3,360,152 | A | 12/1967 | Leers |
| 3,381,123 | A | 4/1968 | Docimo |
| 3,420,995 | A | 1/1969 | Dunckel |
| 3,422,261 | A | 1/1969 | McGinty |
| 3,428,737 | A | 2/1969 | Pou |
| 3,495,024 | A | 2/1970 | Bowman |
| 3,589,660 | A | 6/1971 | Dunckel |
| 3,597,889 | A | 8/1971 | Lo Nigro |
| 3,601,862 | A | 8/1971 | Hargadon |
| 3,630,406 | A | 12/1971 | Hammes |
| 3,647,934 | A | 3/1972 | Hurtt |
| 3,648,878 | A | 3/1972 | Mackay |
| 3,683,173 | A | 8/1972 | Guth |
| 3,700,885 | A | 10/1972 | Bobrick |
| 3,715,627 | A | 2/1973 | D'Ausilio |

(Continued)

*Primary Examiner* — Stephen F Husar
*Assistant Examiner* — Meghan K Dunwiddie

(57) ABSTRACT

A recessed light fixture is provided with a movable junction box. The light fixture has a frame for supporting a lamp housing and lamp socket. A plurality of connection areas are also provided along the frame. A junction box is removably attached to any one of the connection areas using a connection piece.

20 Claims, 7 Drawing Sheets

U.S. PATENT DOCUMENTS

| | | | |
|---|---|---|---|
| 3,743,228 | A | 7/1973 | Drab |
| 3,749,873 | A | 7/1973 | Harper |
| 3,751,574 | A | 8/1973 | Fisher |
| 3,755,667 | A | 8/1973 | Price |
| 3,778,609 | A | 12/1973 | Liberman |
| 3,780,973 | A | 12/1973 | Dalton |
| 3,783,176 | A | 1/1974 | Lund |
| 3,801,815 | A | 4/1974 | Docimo |
| 3,833,113 | A | 9/1974 | Osier |
| 3,872,296 | A | 3/1975 | Cohen |
| 4,000,406 | A | 12/1976 | Bhavsar |
| 4,011,571 | A | 3/1977 | Okuzawa |
| 4,039,822 | A | 8/1977 | Chan |
| 4,041,657 | A | 8/1977 | Schuplin |
| 4,043,629 | A | 8/1977 | Brannen |
| 4,086,480 | A | 4/1978 | Lahm |
| 4,096,964 | A | 6/1978 | Glick |
| 4,104,713 | A | 8/1978 | Chan |
| 4,114,327 | A | 9/1978 | Williams |
| 4,118,760 | A | 10/1978 | Cohon |
| 4,129,948 | A | 12/1978 | Hatter |
| 4,146,287 | A | 3/1979 | Jonsson |
| 4,161,019 | A | 7/1979 | Mulvey |
| 4,173,286 | A | 11/1979 | Stanko |
| 4,191,352 | A | 3/1980 | Schuplin |
| 4,209,103 | A | 6/1980 | Glovier |
| 4,230,297 | A | 10/1980 | Comer |
| 4,230,900 | A | 10/1980 | Speet |
| 4,230,916 | A | 10/1980 | Mochizuki |
| 4,247,738 | A | 1/1981 | Bonato |
| 4,250,540 | A | 2/1981 | Kristofek |
| 4,272,689 | A | 6/1981 | Crosby |
| 4,274,615 | A | 6/1981 | Chan |
| 4,277,641 | A | 7/1981 | Bauer |
| 4,293,895 | A | 10/1981 | Kristofek |
| 4,307,672 | A | 12/1981 | Shikimi |
| 4,313,154 | A | 1/1982 | Capostagno |
| 4,327,403 | A | 4/1982 | Capostagno |
| 4,335,511 | A | 6/1982 | Bowling |
| 4,336,575 | A | 6/1982 | Gilman |
| 4,345,381 | A | 8/1982 | Brislin |
| 4,367,417 | A | 1/1983 | Cassanta |
| 4,388,677 | A | 6/1983 | Druffel |
| 4,388,890 | A | 6/1983 | Wester |
| 4,393,435 | A | 7/1983 | Petrina |
| 4,399,371 | A | 8/1983 | Ziff |
| 4,400,766 | A | 8/1983 | Munson |
| 4,408,262 | A | 10/1983 | Kusmer |
| 4,419,717 | A | 12/1983 | Price |
| 4,424,554 | A | 1/1984 | Woloski |
| 4,428,492 | A | 1/1984 | Jorgensen |
| 4,431,151 | A | 2/1984 | Schonasky |
| 4,449,687 | A | 5/1984 | Karaktin |
| 4,450,512 | A | 5/1984 | Kristofek |
| 4,459,429 | A | 7/1984 | Docimo |
| 4,471,416 | A | 9/1984 | Druffel |
| 4,482,940 | A | 11/1984 | Brandherm |
| 4,497,014 | A | 1/1985 | Woloski |
| 4,500,796 | A | 2/1985 | Quin |
| 4,503,489 | A | 3/1985 | Duerr |
| 4,507,719 | A | 3/1985 | Quiogue |
| 4,522,541 | A | 6/1985 | Bidwell |
| 4,582,737 | A | 4/1986 | Torgerson |
| 4,591,658 | A | 5/1986 | Bauer |
| 4,605,816 | A | 8/1986 | Jorgensen |
| 4,646,212 | A | 2/1987 | Florence |
| 4,661,885 | A | 4/1987 | Brenner |
| 4,674,015 | A | 6/1987 | Smith |
| 4,684,223 | A | 8/1987 | Ikemori |
| 4,686,381 | A | 8/1987 | Boteler |
| 4,705,255 | A | 11/1987 | Reed |
| 4,713,916 | A | 12/1987 | Brooks |
| 4,729,080 | A | 3/1988 | Fremont |
| 4,729,740 | A | 3/1988 | Crowe |
| 4,733,336 | A | 3/1988 | Skogler |
| 4,733,339 | A | 3/1988 | Kelsall |
| 4,741,434 | A | 5/1988 | Liebman |
| 4,745,533 | A | 5/1988 | Smerz |
| 4,751,624 | A | 6/1988 | Russo |
| 4,754,377 | A | 6/1988 | Wenman |
| 4,764,851 | A | 8/1988 | Hartmann |
| 4,792,191 | A | 12/1988 | Farmer |
| 4,803,603 | A | 2/1989 | Carson |
| 4,829,410 | A | 5/1989 | Patel |
| 4,842,551 | A | 6/1989 | Heimann |
| 4,875,871 | A | 10/1989 | Booty |
| 4,894,759 | A | 1/1990 | Siems |
| 4,897,627 | A | 1/1990 | Van Wagener |
| 4,910,651 | A | 3/1990 | Montanez |
| 4,918,258 | A | 4/1990 | Ayer |
| 4,924,032 | A | 5/1990 | Akins |
| 4,958,048 | A | 9/1990 | Bell |
| 4,969,070 | A | 11/1990 | Costa |
| 4,972,339 | A | 11/1990 | Gabrius |
| 4,979,616 | A | 12/1990 | Clanton |
| 4,989,334 | A | 2/1991 | DuBose |
| 5,006,764 | A | 4/1991 | Swanson |
| 5,031,084 | A | 7/1991 | Russo |
| 5,045,985 | A | 9/1991 | Russo |
| 5,057,647 | A | 10/1991 | Bogden |
| 5,057,979 | A | 10/1991 | Carson |
| 5,064,385 | A | 11/1991 | Harlow |
| 5,068,772 | A | 11/1991 | Shapiro |
| 5,075,831 | A | 12/1991 | Stringer |
| 5,077,650 | A | 12/1991 | Cestari |
| 5,094,359 | A | 3/1992 | DeMars |
| 5,096,433 | A | 3/1992 | Boundy |
| 5,103,762 | A | 4/1992 | Long |
| 5,110,038 | A | 5/1992 | Pantisano |
| 5,124,901 | A | 6/1992 | Sojka |
| 5,130,914 | A | 7/1992 | Bengochea |
| 5,138,528 | A | 8/1992 | Altman |
| 5,186,319 | A | 2/1993 | Ting |
| 5,222,800 | A | 6/1993 | Chan |
| 5,236,157 | A | 8/1993 | Reggiani |
| 5,253,152 | A | 10/1993 | Yang |
| 5,260,678 | A | 11/1993 | Van Wagener |
| 5,272,279 | A | 12/1993 | Filshie |
| 5,291,381 | A | 3/1994 | Price |
| 5,314,148 | A | 5/1994 | Jones |
| 5,347,088 | A | 9/1994 | Marsh |
| 5,373,431 | A | 12/1994 | Hayman |
| 5,374,812 | A | 12/1994 | Chan |
| 5,377,075 | A | 12/1994 | Schmid |
| 5,377,088 | A | 12/1994 | Lecluze |
| 5,410,462 | A | 4/1995 | Wolfe |
| 5,420,775 | A | 5/1995 | Kusmer |
| 5,452,193 | A | 9/1995 | Hinnefeld |
| 5,452,816 | A | 9/1995 | Chan |
| 5,465,199 | A | 11/1995 | Bray |
| 5,538,214 | A | 7/1996 | Simila |
| 5,562,343 | A | 10/1996 | Chan |
| 5,564,815 | A | 10/1996 | Littman |
| 5,588,737 | A | 12/1996 | Kusmer |
| 5,597,234 | A | 1/1997 | Winkelhake |
| 5,609,414 | A | 3/1997 | Caluori |
| 5,630,663 | A | 5/1997 | Ling |
| 5,664,869 | A | 9/1997 | Bitton |
| 5,669,324 | A | 9/1997 | Muir |
| 5,678,794 | A | 10/1997 | Kump |
| 5,690,423 | A | 11/1997 | Hentz |
| 5,707,143 | A | 1/1998 | Hentz |
| 5,715,808 | A | 2/1998 | Wilhoite |
| 5,720,540 | A | 2/1998 | Crown |
| 5,725,302 | A | 3/1998 | Sirkin |
| 5,741,064 | A | 4/1998 | Chin |
| 5,746,507 | A | 5/1998 | Lee |
| 5,758,959 | A | 6/1998 | Sieczkowski |
| 5,803,585 | A | 9/1998 | Littman |
| 5,836,678 | A | 11/1998 | Wright |
| 5,845,988 | A | 12/1998 | Mandall |
| 5,857,766 | A | 1/1999 | Sieczkowski |
| 5,908,235 | A | 6/1999 | Petrozello |
| 5,951,151 | A | 9/1999 | Doubeck |
| 5,957,572 | A | 9/1999 | Wedekind |
| 5,957,573 | A | 9/1999 | Wedekind |
| 5,957,574 | A * | 9/1999 | Hentz et al. ..... 362/365 |

6,000,818 A 12/1999 Caluori
6,004,011 A * 12/1999 Sieczkowski ..... 362/365
6,033,098 A 3/2000 Hentz
6,062,704 A 5/2000 Holder
6,095,669 A 8/2000 Cho
6,095,671 A 8/2000 Hutain
6,098,825 A 8/2000 Kohnen
6,102,550 A 8/2000 Edwards
6,102,733 A 8/2000 Anderson
6,133,529 A 10/2000 Gretz
6,142,439 A 11/2000 Aramaki
6,145,798 A 11/2000 Janisse
6,166,329 A 12/2000 Oliver
6,272,794 B1 8/2001 Rippel
6,290,375 B1 9/2001 LeVasseur
6,293,510 B1 9/2001 Bradford
6,343,873 B1 2/2002 Eberhard
6,369,326 B1 4/2002 Rippel
6,383,032 B1 5/2002 Gerberding
6,402,112 B1 6/2002 Thomas
6,421,904 B1 7/2002 Wedekind
6,461,016 B1 10/2002 Jamison
6,554,457 B1 4/2003 Platt
6,582,106 B2 6/2003 Jamison
6,632,006 B1 10/2003 Rippel
6,659,627 B2 12/2003 Caluori
6,747,206 B1 6/2004 Law
6,777,611 B2 8/2004 Ewald
7,118,254 B2 10/2006 Czech
7,303,314 B2 12/2007 Jones
7,357,541 B2 4/2008 Gamache
2003/0115767 A1 6/2003 Wedekind
2005/0227536 A1 10/2005 Gamache
2006/0056170 A1 3/2006 Todorovic
2006/0274536 A1 12/2006 Hagen

* cited by examiner

RECESSED LIGHT FIXTURE WITH A MOVABLE JUNCTION BOX

CROSS-REFERENCE TO RELATED APPLICATIONS

Not Applicable.

BACKGROUND

1. Field of the Invention

The present invention is related generally to a recessed light fixture and, more particularly, to a recessed light fixture frame having a movable junction box.

2. Description of Related Art

Recessed lighting, where a lighting assembly is mounted in a ceiling or the like, is in common usage in the lighting industry. Generally, a lamp is mounted in a socket within a lamp housing and the lamp housing is secured in a ceiling or the like by a fixture or bracket, commonly known as a frame. The frame may be mounted directly to a joist or include slots for hanger bars, which extend to and are fastened to and between joists.

DETAILED DESCRIPTION

Figure 1:
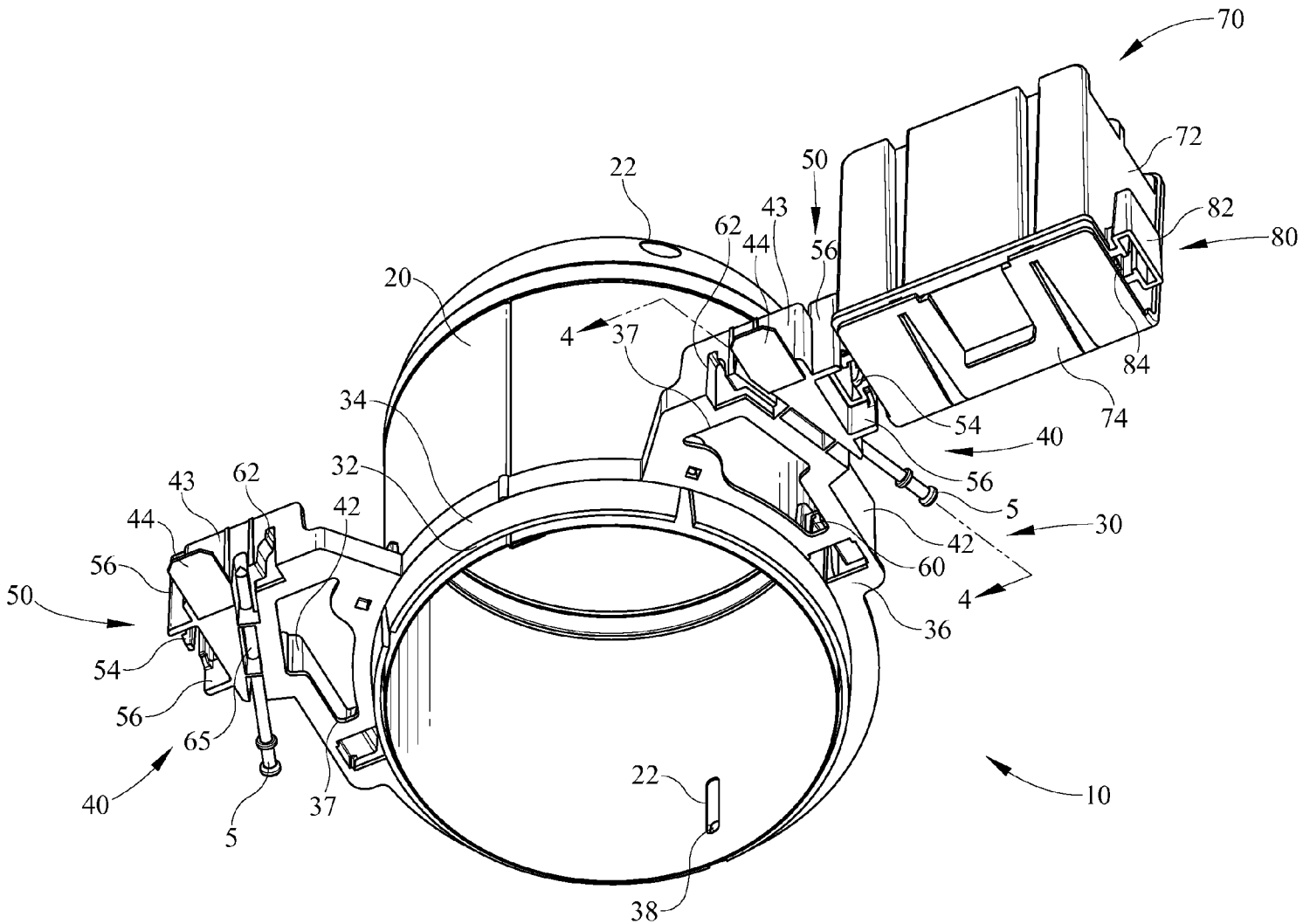
FIG. 1 is a bottom perspective view of an embodiment of a recessed light fixture shown holding a lamp housing.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring now in detail to FIGS. 1-7, wherein like numerals indicate like elements throughout the several views, there are shown various aspects of a recessed lighting fixture having a movable junction box. Referring to FIG. 1, a recessed light fixture 10 is shown supporting a lamp housing 20, and comprising a frame 30 and a movable junction box 70. In some embodiments frame 30 and junction box 70 are molded of a polymeric material. In other embodiments frame 30 and junction box 70 are constructed from other materials, including metals such as zinc. Junction box 70 can be removably coupled to any one of two or more connection areas 50 comprising part of frame 30 and provided along the periphery of frame 30. Thus, junction box 70 can be moved to any one of a plurality of locations along frame 30 during installation of recessed light fixture 10 if desired. This may allow for more convenient wiring of junction box 70 or may allow junction box 70 to be repositioned to avoid obstacles such as air ducts, pipes, or joists, such as joist 14 shown in FIG. 2.

Frame 30 of the illustrated embodiment outlines an aperture or frame aperture periphery 32 lying in a first plane. The periphery of aperture 32 is defined by the base of an aperture sidewall 34 extending in a direction generally perpendicular to the first plane in which aperture 32 lies. Aperture sidewall 34 has a flange 36 lying in a plane substantially parallel to the first plane defined by aperture 32 and extending partially around aperture sidewall 34. Flange 36 provides additional strength for aperture sidewall 34 and additional support for support elements 40, which also form part of frame 30. In other embodiments flange 36 may not be provided or may take on alternative configurations. Also, although FIGS. 1-7 depict a circular aperture 32, other embodiments of recessed light fixture 10 are provided with apertures of differing shapes and sidewalls of differing configurations and orientations.

Figure 3:
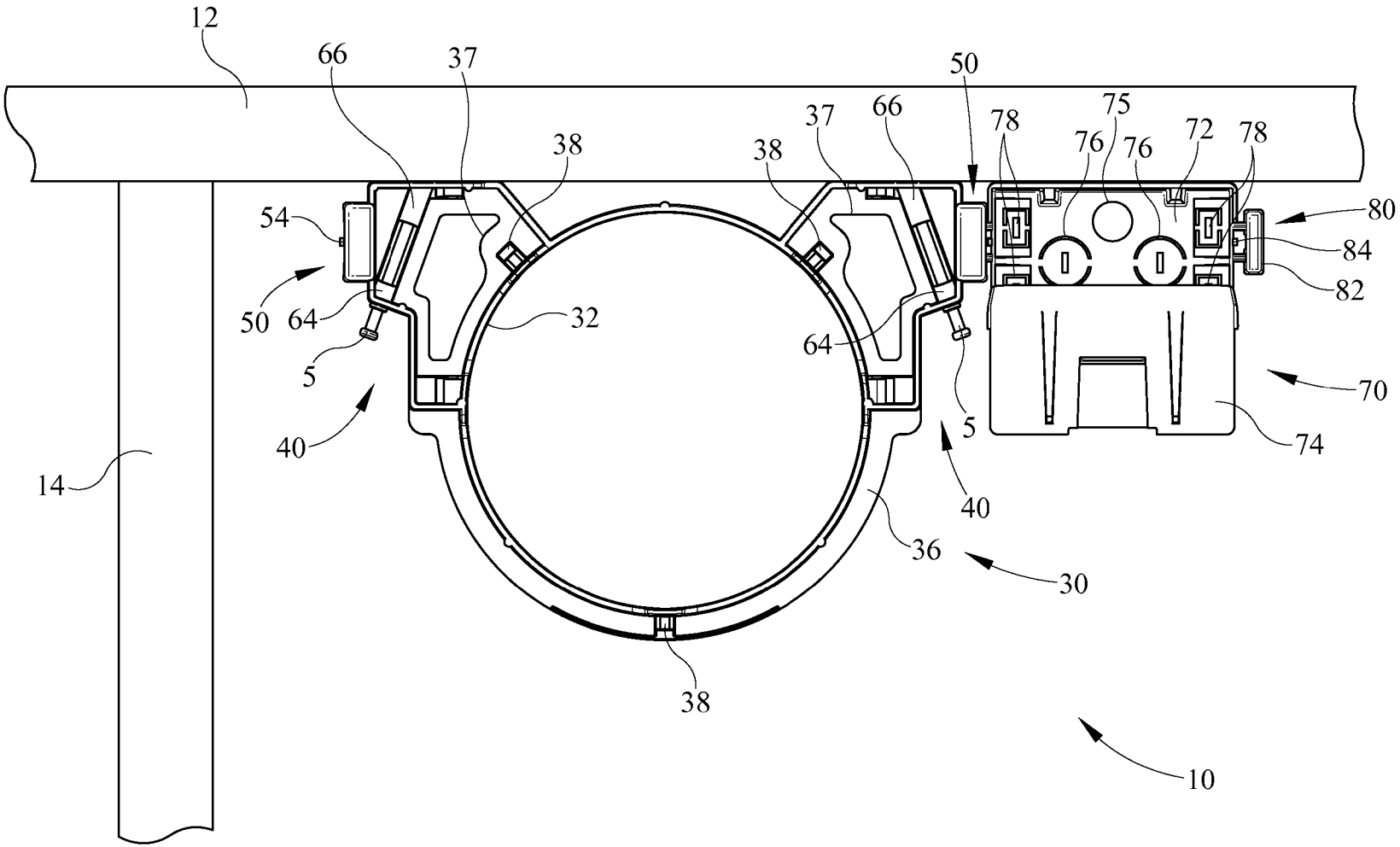
FIG. 3 is a plan view of FIG. 2 shown without the lamp housing and exemplary electrical connections.
Figure 4:
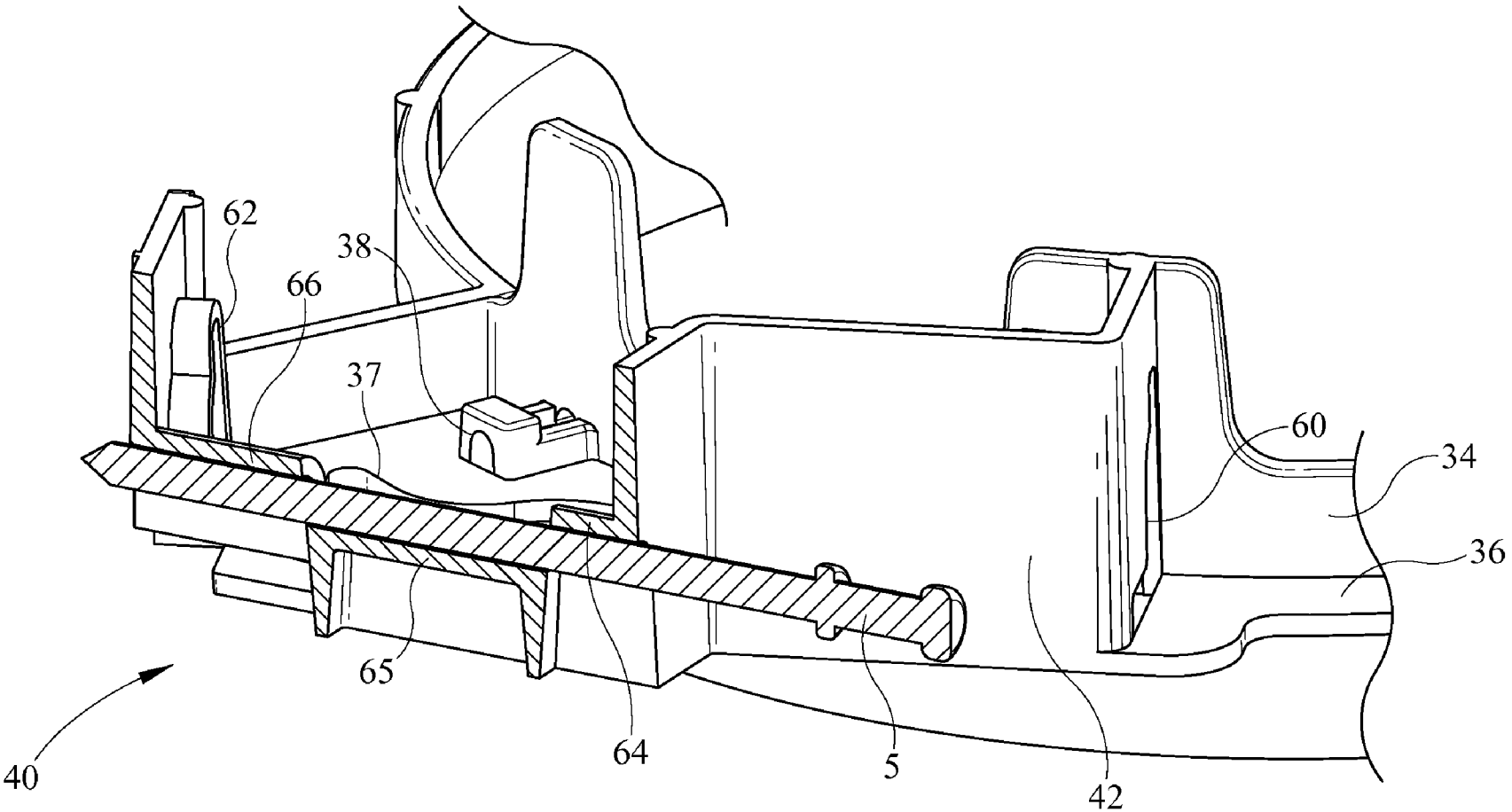
FIG. 4 is a perspective view of a portion of the recessed light fixture of FIG. 1 taken along the line 4-4.

Referring to FIG. 3 and FIG. 4, channels 38 are proximal flange 36, extend through aperture sidewall 34 and receive screws, tabs with barbs, snap fits, or other securing devices. In the illustrated embodiment securing devices may be inserted through channels 38 and alignment apertures 22 of lamp housing 20, one of which is shown in FIG. 1, to secure lamp housing 20 when it is received by frame 30. Alignment apertures 22 enable lamp housing 20 to be adjusted and secured at varying positions along the length of apertures 22. With reference to FIG. 3, the illustrated embodiment has three channels 38 spaced about frame 30 that may be aligned with three corresponding alignment apertures. In other embodiments more or less channels 38 and different spacing are used.

Shown throughout the Figures and also comprising part of frame 30 are support elements 40 coupled to the periphery of aperture sidewall 34. Of course the frame 30 can be comprised of many traditional frame structures which vary from the embodiments shown including pan style frames, limited radial frame structures or other frame elements which allow a recessed fixture to be readily placed into the ailing and not necessarily requiring support elements and other structure of the multiple embodiments. In some embodiments support elements 40 may vary from one another and may take on a number of forms. However, in the illustrated embodiments support elements 40 are identical to one another and will therefore be described in conjunction. Flange 36 extends outwardly from aperture 32 to provide support for, and form the base of support element 40. In some embodiments flange 36 has one or more openings, such as openings 37 to save on materials cost, while still providing sufficient support for support element 40. Support sidewall 42 connects to aperture sidewall 34 and extends in a direction substantially perpendicular to flange 36. Support sidewall 42 has a joist abutting portion 43 that lies in a second plane substantially perpendicular to the first plane in which aperture 32 lies. In some embodiments and in some installation methods, joist abutting portion 43 will abut a joist to which recessed light fixture 10 is installed. For example, with reference to FIG. 2 and FIG. 3, just abutting portion 43 abuts a joist 12 to which recessed light fixture 10 is installed. In other embodiments and installation methods joist abutting portion 43 will not abut a joist but may instead, for example, face a surface to which hanger bars are attached.

Referring to FIG. 3, comprising part of support elements 40 are hanger bar supports 60 and 62 which define a hanger bar passageway through which hanger bars (not shown) can be inserted when hanging recessed light fixture 10 by hanger bars. The illustrated hanger bar supports 60 and 62 are generally "L" shaped and are adapted to receive two part hanger bars that telescope together with each part being inserted into the hanger bar supports 60 and 62 from opposite ends. The general "L" shape of the hanger bar supports 60 and 62 enables inserted hanger bars to lie either in a plane perpendicular to or parallel to flange 36. Although the hanger bar passageway may be defined by hanger bar supports 60 and 62, the hanger bar passageway could take on a number of embodiments. For exemplary purposes only, the hanger bar passageway could be defined by a singular hanger bar support, or more than two hanger bar supports. Similarly, the hanger bar passageway could be shaped so as to allow inserted hanger bars to lie only in a plane perpendicular to, only in a plane parallel to, or only in a plane angled with respect to flange 36.

With particular reference to FIG. 4, also comprising a portion of each support element 40 is a nail passageway. The nail passageway in the illustrated embodiment is defined by nail wall portions 64, 65, and 66. Nail wall portions 64, 65, and 66 are positioned to appropriately guide a nail, such as nail 5 shown throughout the Figures, through the nail passageway. In some embodiments where two nail passageways are provided through two support elements 40, the nail passageways are positioned at intersecting angles to one another, such as those shown throughout the Figures. To mount recessed light fixture 10 directly to a joist, joist abutting portion 43 of sidewall 42 can be abutted against a joist. Then, nails can be inserted through the portion of support elements 40 providing access to the nail passageways and using a hammer or the like, the nail can be driven through the nail passageway and into the joist. Alignment tabs 44 are also shown in FIGS. 5-7 that extend from flange 36 near joist abutting portion 43 and may be used to align recessed lighting fixture 10 to a bottom edge of a joist, such as joist 12 of FIGS. 2 and 3.

Ribs may be provided extending into the nail passageway that press against an inserted nail to maintain the nail in position. Nails may be provided in each nail passageway of the recessed lighting fixture 10 at the factory and held in place by ribs or otherwise, so that the correct size and type of nail need not be searched for during the installation process. The nail passageway could take on a number of embodiments. For exemplary purposes only, the nail passageway could be defined by a single orifice extending throughout nail passageway or by different configurations of wall portions positioned on the top and bottom of the nail passageway. Similarly, the nail passageway could be easily adapted to receive a screw or other securing device. Although each support element 40 has been described as having both hanger bar passageways and nail passageways, each support element 40 could also have only one of the two or other configurations.

Coupled with frame 30 is a connection area 50. Connection area 50 is located on the periphery of frame 30 and at least two connection areas 50 comprise a part of frame 30. In the Figures two connection areas 50 are positioned on a peripheral edge of frame 30 and are integrally formed on an outward facing portion of each support element 40. In other embodiments connection areas 50 are provided at different, positions along the periphery of frame 30. Each connection area 50 is configured to engage a corresponding connection piece 80 for selectively connecting junction box 70 to either one of connection areas 50. Referring to FIGS. 5-7, junction box 70 has two integrally formed connection pieces 80 positioned such that junction box 70 can face the same general direction when connected to either connection area 50. Connection pieces 80 are provided on opposed sides of junction box 70 and generally face opposite directions. In other embodiments only one connection piece 80 is provided. In some embodiments one or more connection pieces 80 may be provided on other surfaces of junction box 70, at other orientations with respect to junction box 70, or may be provided non-integral with junction box 70.

Figure 5:
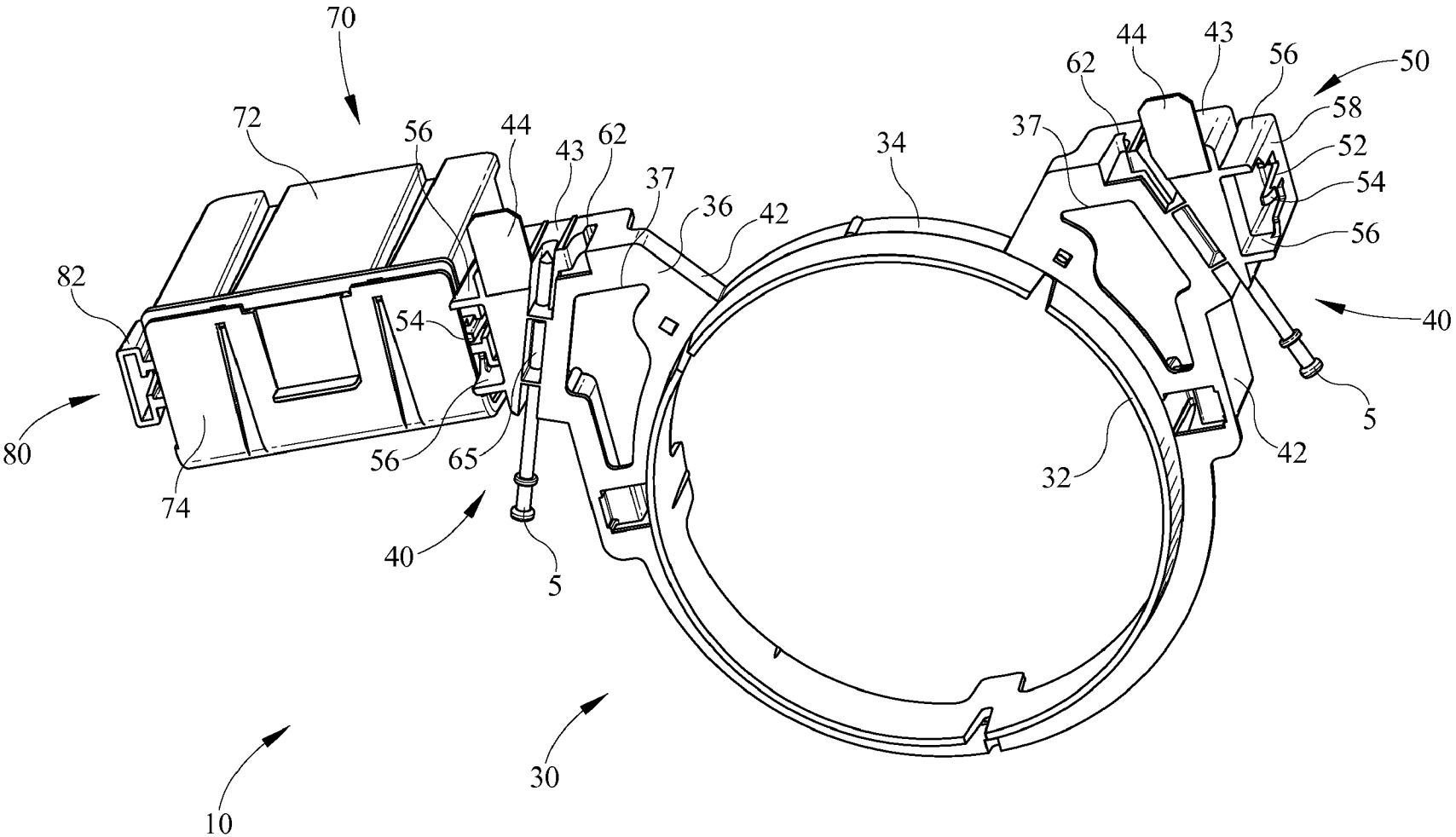
FIG. 5 is a bottom perspective view of the recessed light fixture of FIG. 1.
Figure 6:
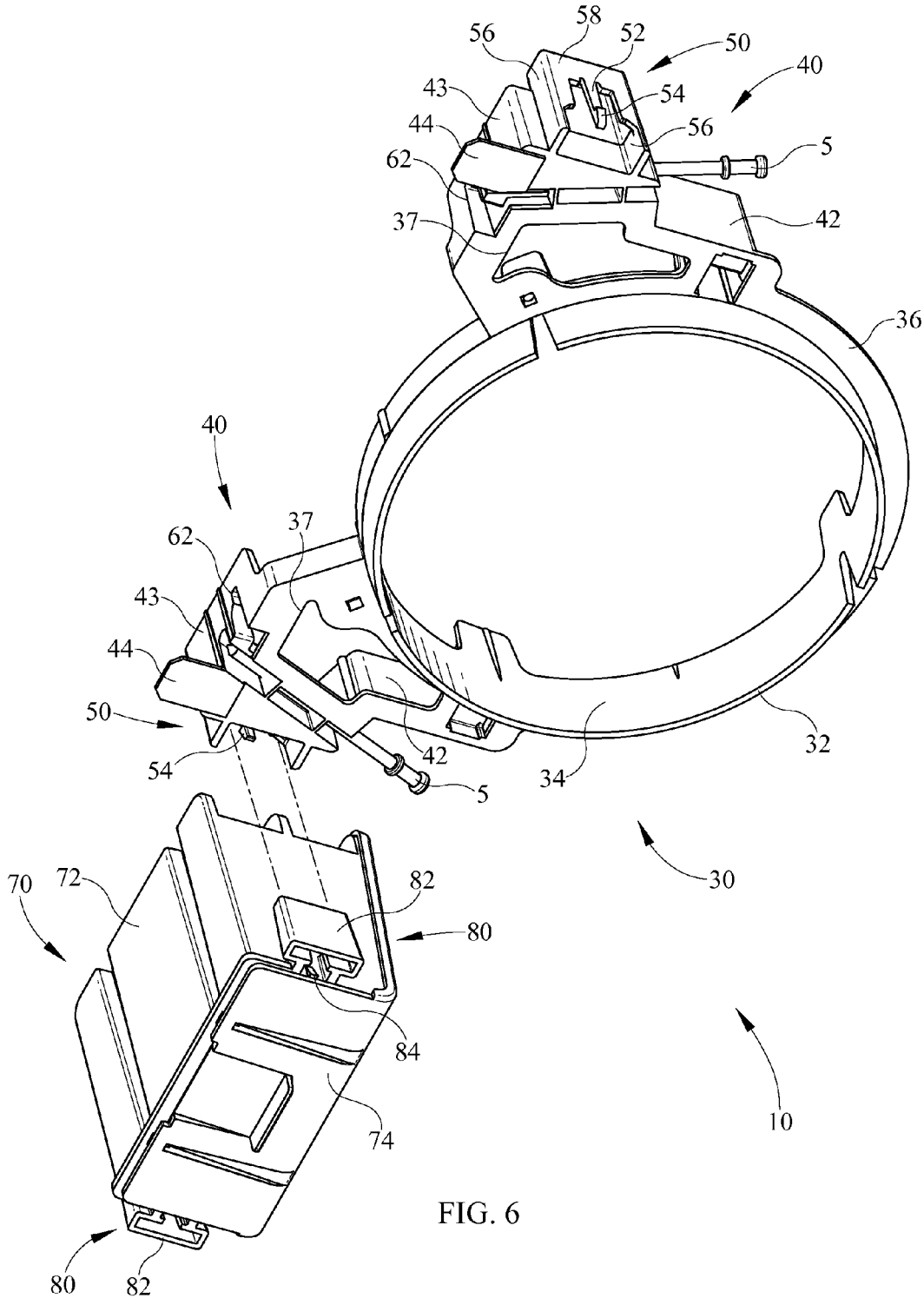
FIG. 6 is a bottom perspective view of the recessed light fixture of FIG. 1 with a movable junction box exploded away.
Figure 7:
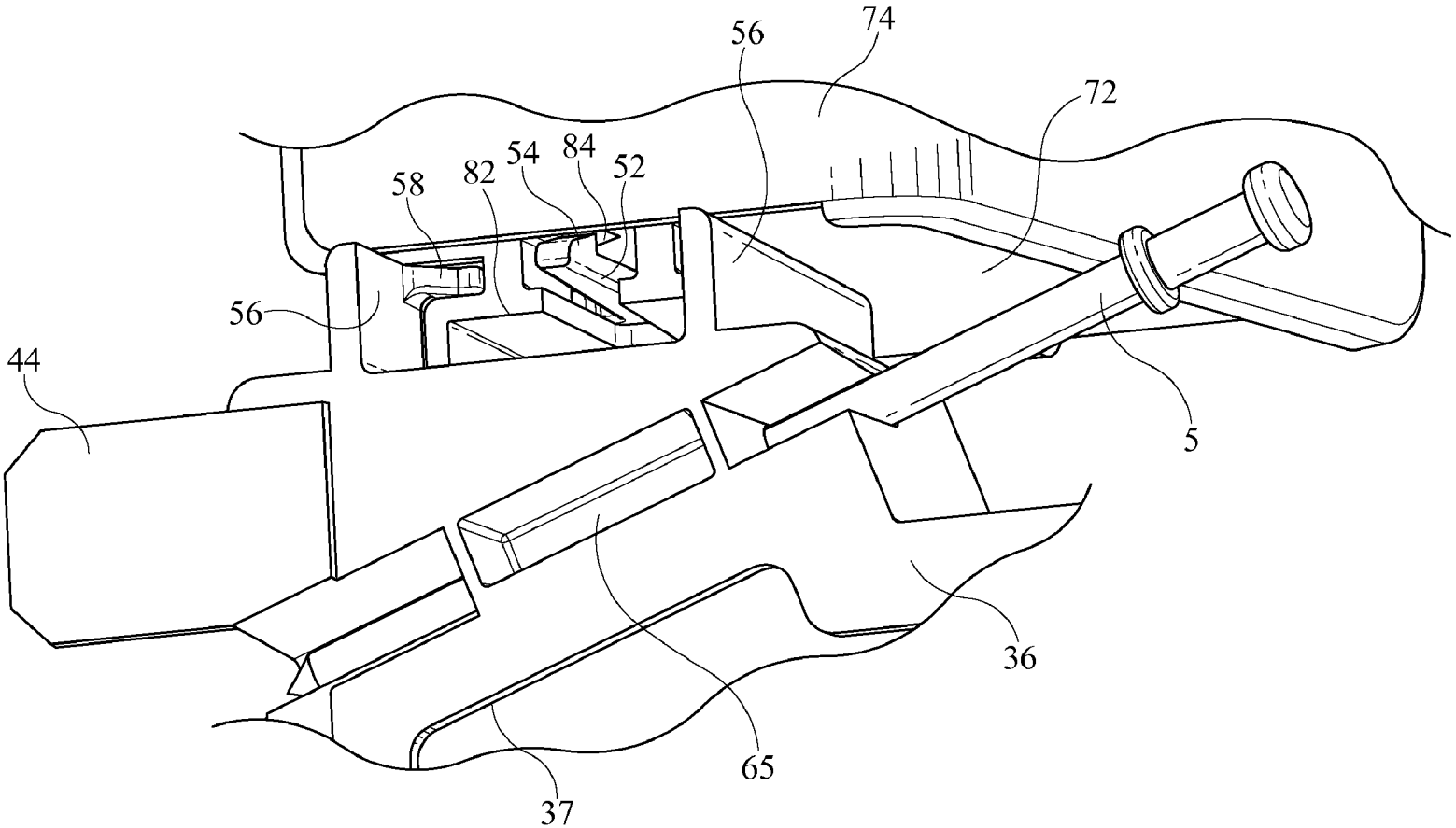
FIG. 7 is a bottom perspective view of a portion of the recessed light fixture of FIG. 1 showing an embodiment of a connection piece and connection area in more detail.

With continuing reference to FIGS. 5-7, one embodiment of connection area 50 and connection piece 80 is described in more detail. Connection area 50 comprises an integrally connected flexible cantilever latch member 52 with protrusion 54. Cantilever latch member 52 is outwardly placed by virtue of opposed walls 56 and sits in substantially the same plane as front wall 58. In this embodiment connection piece 80 comprises at least one connection slide 82 and a protrusion 84, both integrally connected to junction box 70. As shown in FIGS. 6 and 7, junction box 70 is selectively connectable to any one connection area 50 by inserting connection slide 82 into the void created by opposed walls 56 and front wall 58 until protrusion 54 engages protrusion 84. Junction box 70 may be disconnected from connection area 50 by disengaging protrusion 54 from protrusion 84 and removing connection slide 82 from the void created by opposed walls 56 and front wall 58.

Of course, connection areas 50 and one or more connection pieces 80 may take on a number of embodiments for removable connection of junction box 70. For example, in some embodiments each connection piece 80 may comprise a cantilever latch member having a protrusion and each connection area 50 may comprise a connection slide and a protrusion that engages the protrusion of the latch member. In some embodiments each connection piece 80 may comprise one or more screws insertable through junction box 70 and receivable in one or more threaded apertures that comprise each connection area 50. In some embodiments connection piece 80 may comprise a male protrusion with one or more slots receivable in a connection area 50 that comprises a female receptor with matching pins or slots. These are merely exemplary of the multitude of embodiments connection areas 50 and one or more connection pieces 80 may take on for removable connection of junction box 70.

Figure 2:
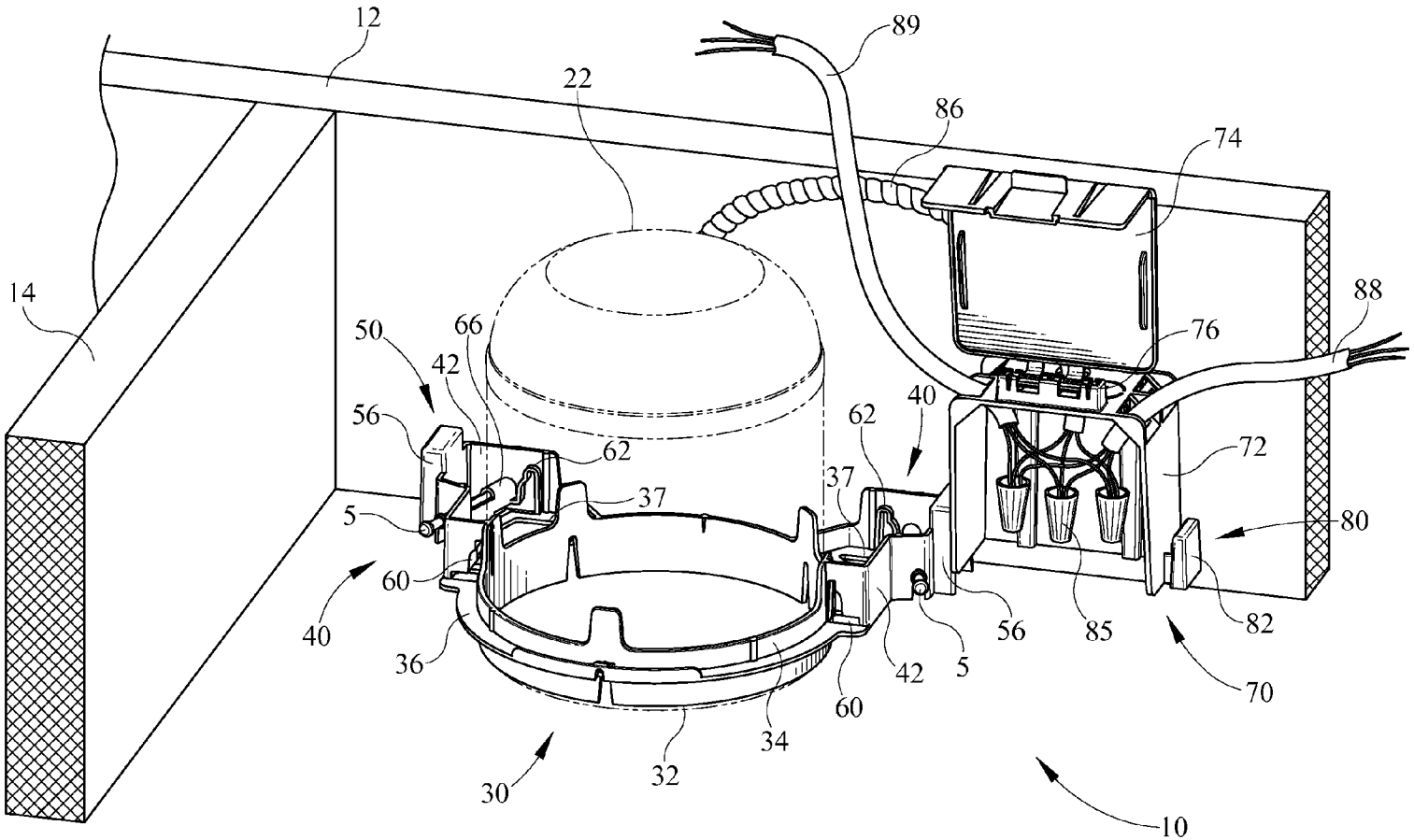
FIG. 2 is a top perspective view of the recessed light fixture of FIG. 1 mounted to a ceiling joist, with the lamp housing of FIG. 1 shown in phantom, and with exemplary electrical connections also shown.

Referring to FIGS. 1-3, the depicted embodiment of junction box 70 is described in more detail. Junction box 70 comprises a first housing portion 72 to which a door 74 is connected by a hinge 76 (shown in FIG. 2). Door 72 is shown in an open position in FIG. 2 and FIG. 3 to allow a user access to wiring, such as wiring connections 85 shown in FIG. 2. Door 72 is shown in the closed position in the remaining Figures. In some embodiments door 72 is designed so that in the open position the interior of junction box 70 and any wiring such as wiring connections 85 are accessible from the front as well as from below, allowing wiring to be installed and maintained after recessed lighting fixture 10 has been installed in the ceiling or otherwise. Wiring connections 85 could also be accessible from inside aperture 32 if lamp housing 20 is removed.

With continuing reference to FIG. 2, power may be supplied to any light socket maintained in lamp housing 20 via wiring raceway 86 leading from junction box 70 to lamp housing aperture 22. As shown in FIG. 3, in some embodiments an opening 75 may be located through the top of junction box 70 for insertion of wiring raceway 86. In some embodiments a pair of circular knockouts 76 may also be located on the top of junction box 70. In some embodiments junction box 70 also includes corner knockouts 78, two on each top corner of junction box 70. Each corner knockout 78 and circular knockout 76 may be selectively removed to allow for wiring to be inserted therethrough, such as cables 88 and 89 shown in FIG. 2 connected into the junction box at wiring connections 85. Electrical cables, such as cables 88 and 89 may supply power to junction box 70 and to other sequentially connected lighting fixtures (not shown). Of course, junction box 70 can take on a number of embodiments and still be removably coupled to any one of two or more connection areas 50 comprising part of frame 30.

The foregoing description has been presented for purposes of illustration. It is not intended to be exhaustive or to limit the invention to the precise forms disclosed, and obviously many modifications and variations are possible in light of the above teaching. It is understood that while certain forms of the recessed light fixture with a moveable junction box have been illustrated and described, it is not limited thereto except insofar as such limitations are included in the following claims and allowable functional equivalents thereof.

The invention claimed is:

1. A recessed luminaire, comprising:

a lamp housing for substantially surrounding a lamp and having an opening defining a light exit aperture;

a frame supporting said lamp housing and having a frame aperture periphery and a plurality of connection areas, each of said connection areas being connected to said frame aperture periphery;

said frame aperture periphery at least partially surrounding said lamp housing;

a junction box removably attached to any of said plurality of connection areas of said frame;

a connection piece on said junction box for removably attaching said junction box to any of said plurality of connection areas of said frame.

2. The recessed luminaire of claim 1, wherein each said connection area has a flexible cantilever latch member and said connection piece is at least one protrusion coupled to said junction box, wherein each said flexible cantilever latch member is designed to removably engage each said protrusion.

3. The recessed luminaire of claim 1, wherein each said connection area has a protrusion and said connection piece is at least one flexible cantilever latch member coupled to said junction box, wherein each said flexible cantilever latch member is designed to removably engage each said protrusion.

4. The recessed luminaire of claim 1, wherein each said connection area has at least one threaded aperture formed therein and said connection piece is at least one screw removably insertable through said junction box and removably receivable in said threaded aperture.

5. The recessed luminaire of claim 1, wherein said junction box has at least one threaded aperture formed therein and said connection piece is at least one screw removably insertable through each said connection area and removably receivable in said threaded aperture.

6. The recessed luminaire of claim 1 further comprising two support elements forming a portion of said frame.

7. The recessed luminaire of claim 6, wherein a first and second connection area are provided, each said connection area coupled to a support element.

8. A recessed light fixture frame, comprising:

a lamp housing for substantially surrounding a lamp and having an opening defining a light exit aperture;

a frame supporting said lamp housing and having an aperture sidewall, at least one support element, and a plurality of connection areas, each of said connection areas being connected to said aperture sidewall;

said aperture sidewall at least partially surrounding said lamp housing and defining a frame aperture;

each said support element coupled to the periphery of said aperture sidewall and having a joist abutting surface and a passageway;

each said passageway extending through said support element and toward said joist abutting surface;

each said connection area positioned along the periphery of said frame;

a junction box removably attached to any of said plurality of connection areas of said frame;

a connection piece for removably attaching said junction box to said plurality of connection areas of said frame.

9. The recessed luminaire of claim 8, wherein each said connection area has a flexible cantilever latch member and said connection piece is at least one protrusion coupled to said junction box, wherein each said flexible cantilever latch member is designed to removably engage each said protrusion.

10. The recessed luminaire of claim 8, wherein each said connection area has a protrusion and said connection piece is at least one flexible cantilever latch member coupled to said junction box, wherein each said flexible cantilever latch member is designed to removably engage each said protrusion.

11. The recessed luminaire of claim 8, wherein two said support elements are provided and a first and second connection area are provided, each said connection area coupled to a support element.

12. The recessed luminaire of claim 11, wherein said passageways are configured to receive nails and are positioned at intersecting angles with respect to one another.

13. The recessed luminaire of claim 11, wherein said passageways are configured to receive hanger bars.

14. The recessed luminaire of claim 11, wherein each said connection area has a flexible cantilever latch member and said connection piece is at least one protrusion coupled to said junction box, wherein each said flexible cantilever latch member is designed to removably engage each said protrusion.

15. A recessed light fixture having a repositionable junction box, comprising:

a trim frame element supporting an upstanding housing, said trim frame defining a downlight aperture;

said trim frame having an aperture sidewall and a first and second support element, each of said support elements being connected to said aperture sidewall;

a junction box having at least one connection piece, wherein said at least one connection piece is removably connected to said first support element or said second support element on said trim frame;

wherein said removable connection between said junction box and said trim frame allows said junction box to be installed on either a first side or a second side of said recessed light fixture.

16. The recessed light fixture having a repositionable junction box of claim 15, wherein said trim frame is an annular support frame installable above a ceiling line.

17. The recessed light fixture having a repositionable junction box of claim 15, wherein each said connection piece of said junction box has a protrusion that can removably engage a flexible cantilever latch member coupled to said first support element and said second support element.

18. The recessed light fixture having a repositionable junction box of claim 16, wherein each said connection piece of said junction box has a flexible cantilever latch member that can removably engage a protrusion coupled to said first support element and said second support element.

19. The recessed light fixture having a repositionable junction box of claim 16, wherein said first support element and said second support element are positioned on a peripheral edge of said annular support frame.

20. The recessed light fixture having a repositionable junction box of claim 19, wherein each said connection piece of said junction box has a protrusion that can removably engage a flexible cantilever latch member coupled to said first support element and said second support element.

* * * * *